US005496516A

United States Patent [19]

Finkl et al.

[11] Patent Number: 5,496,516

[45] Date of Patent: Mar. 5, 1996

[54] DUAL PURPOSE STEEL AND PRODUCTS PRODUCED THEREFROM

[75] Inventors: Charles W. Finkl, Evanston; Algirdas A. Underys, Arlington Heights, both of Ill.

[73] Assignee: A. Finkl & Sons Co., Chicago, Ill.

[21] Appl. No.: 222,412

[22] Filed: Apr. 4, 1994

[51] Int. Cl.[6] ..... C22C 38/44; C22C 38/46; C22C 38/50

[52] U.S. Cl. ..... 420/109

[58] Field of Search ..... 420/109

[56] References Cited

U.S. PATENT DOCUMENTS

| | | | |
|---|---|---|---|
| 4,318,739 | 3/1982 | Lehman | 420/109 |
| 5,244,626 | 9/1993 | Finkl et al. | 420/109 |

*Primary Examiner*—Deborah Yee
*Attorney, Agent, or Firm*—Baker & McKenzie

[57] ABSTRACT

A dual purpose steel having high strength, high hardness, high wear resistance, high hardenability and easy machining and therefore being equally well suited for (a) elevated temperature closed die forging (b) room temperature machine part applications, such as gears, pinions, etc.

3 Claims, 2 Drawing Sheets

DUAL PURPOSE STEEL AND PRODUCTS PRODUCED THEREFROM

This invention relates generally to a low alloy steel suitable for use both as a closed forging die intended to operate at elevated temperatures, and as a machine part intended to operate at room temperatures. It further relates specifically to a steel which can be initially fabricated as a die block or as a semi- or fully finished machine part, but which, in either form, is characterized by superior ductility at room temperature together with high strength, high hardness, high wear resistance, and high hardenability.

The invention steel and end products are a distinct improvement over the steel and end products disclosed in U.S. Pat. No. 4,318,739. It should be noted however that the steel of this invention, either in die block or machine part form, may be manufactured by the same, or a substantially similar, process as the process described in U.S. Pat. No. 4,318,739, and accordingly a description of the mode of manufacture of said dual purpose steel will not be included herein, the disclosure of said U.S. Pat. No. 4,318,739 being incorporated herein by reference.

BACKGROUND OF THE INVENTION

Steels of the general composition described in U.S. Pat. Nos. 1,464,174, 2,331,900 and, most recently, 4,318,739 have been developed to a high degree of proficiency and today such steels have acquired a reputation in the closed die forging industry for quality and durability; indeed one, which is sold under the trademark FX, has long been recognized as a leading steel in this industry. In particular, the improvements in this steel attributable to U.S. Pat. No. 4,318,739 allowed the owner of said patent to warrant the steel against die failure, the only such warranty presently known in the industry.

Other applications of the above material include, but are not limited to, replacement machine parts such as gears, pinions, pistons and crankshafts. The up and running operating requirements for a steel for this application are somewhat similar to those of a die steel for closed die forging—high strength, high wear resistance, high hardenability and ease of machining. There are significant differences, however.

For example, some closed die forge shops neglect to preheat dies before the start of a production run. In cold weather, when a die is not used for an extended period of time, and is put into production without adequate preheating, catastrophic die failure can occur. To alleviate this mode of die failure typical closed die forging procedures require preheating the dies to a temperature above the brittle-to-ductile transition temperature before use, which may be approximately 300° F. At typical closed die forging die temperatures the above-described steel has high impact toughness as well as high ductility.

One very important way in which machine part applications differ significantly from closed die forging die applications is that machine parts are used at room temperature, and therefore the ductility of the material at room temperature is much more critical than in die steel applications. Experience has shown, however, that the steel of U.S. Pat. No. 4,318,739, when used as a machine part, does not give the same superior performance as when used as closed forging die. In particular, it became apparent that improved room temperature ductility was highly desirable provided that the strength, wear resistance, hardenability, easy machinability and other beneficial characteristics of the steel, when used as a die steel, would not be sacrificed. By achieving increased room temperature ductility the steel could be truly termed to be a universal or dual steel in the sense that the steel maker could melt to one range and yet provide steel suitable for use in two substantially different applications, one requiring high room temperature ductility and the other not, while retaining all of the positive attributes of the die steel application—high strength, high wear resistance, high hardenability and ease of machining.

SUMMARY OF THE INVENTION

The invention is a steel, and products made therefrom, suitable for use either in a closed die forging application or in a machine part application which, using fabrication techniques dictated by the closed die forging application, achieve the dual application status solely by relatively small, yet significant, chemistry modifications.

BRIEF DESCRIPTION OF THE DRAWING

The attributes of the invention are exemplified in the accompanying drawing in which.

Figure 1:
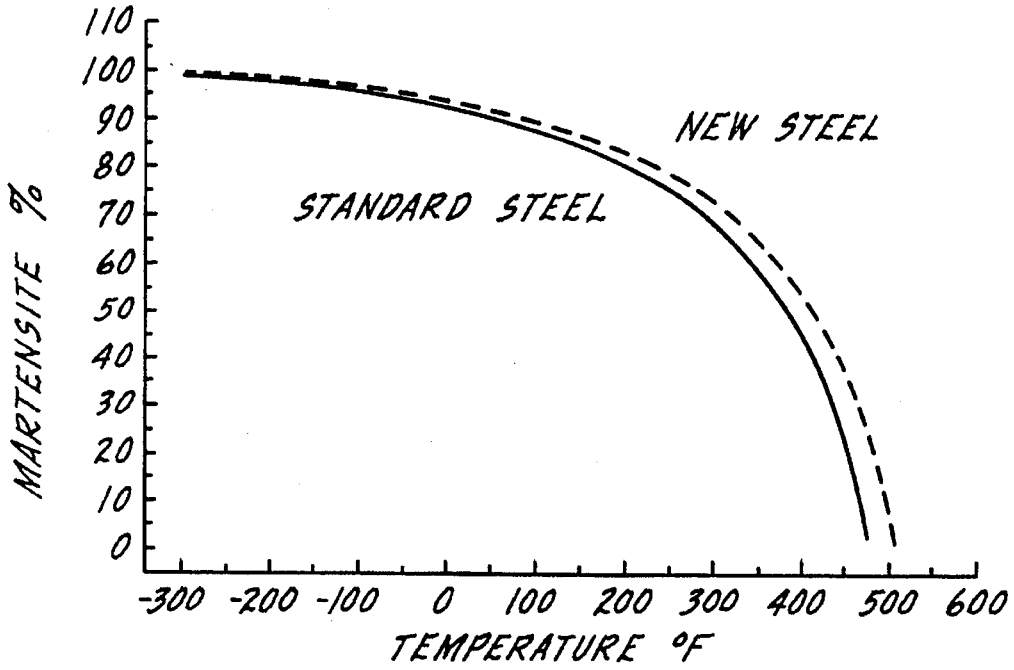
FIG. 1 is a diagram of the martensite transformation temperatures of the steel and product of this invention as contrasted to a steel and product known in the prior art.

The necessary chemical modifications will be appreciated from the following.

A basic tenet of metallurgy is that the best physical properties of a steel are obtained when the heat treated structure of the material is tempered martensite. Therefore, to improve the ductility of a material the amount of martensite that is created during the quenching process must be maximized. Since the steel of this invention is currently drastically quenched to achieve its physical properties ductility cannot be improved by modifying heat treatments parameters. Applicant discovered however that the amount of martensite transformed during the heat treatment process can be increased by modifying the chemistry.

Set out below are the broad and preferred ranges of the composition of the steel of this invention.

| | Broad | Preferred A | Preferred B |
|---|---|---|---|
| C | .48/.60 | .48/.53 | .48/.53 |
| Mn | .75/.95 | .75/.95 | .75/.95 |
| P | .025x | .025x | .025x |
| S | .025x | .025x | .025x |
| Si | .15/.35 | .15/.35 | .15/.35 |
| NI | .60/2.00 | .80/1.40 | .80/1.40 |
| Cr | .85/1.30 | 1.00/1.30 | 1.00/1.30 |
| Mo | .40/.85 | .40/.55 | .65/.85 |
| V | 0/.30 | .04/.10 | .04/.10 |
| Al | 0/.030 | .015/.025 | .015/.025 |
| Ti | .003/.020 | .005/.015 | .005/.015 |

A brief discussion of the considerations attendant to the attributes, and disadvantages, inherent in each element, when directed to the dual final application above described, follows. It should be understood that when the terms "lowered" or "increased" or other comparative phrases are used, the standard of comparison is the composition disclosed in U.S. Pat. No. 4,318,739.

Carbon, in increasing amounts, lowers the temperature that transformation to martensite begins. However, as the temperature is lowered, an increased amount of less desirable transformation products, such bainite and pearlite, are formed. From the broad perspective of the objectives to be attained however carbon should be lowered to improve ductility, and hence carbon should be present in the range of 0.48–0.53 and can be tolerated in the range of 0.48–0.60. Decreasing the carbon content has a disadvantageous effect however in that carbon is essential to provide the necessary strength and hardness for hot working application of the steel in closed die forging. Carbon also greatly influences the hardenability, that its, how deeply hardness will penetrate a given cross-section. Therefore, lowering carbon must somehow be compensated for if satisfactory performance in closed die forging applications is to be maintained while at the same time providing a product having high room temperature ductility.

Manganese should be present in the range of 0.75–0.95 Decreasing manganese will increase the possibility of red shortness caused by sulphur. Decreasing manganese will detract from the hardenability of the steel. Increasing the manganese content will lower the transformation temperature of martensite, thereby decreasing ductility.

Phosphorous should be present in an amount no greater than 0.025% maximum, which is a level that is economically feasible to attain.

Lower sulphur levels would improve the ductility of the material. Sulphur, however, is required to maintain the easy machinability of the steel. The sulphur level preferably should be maintained below 0.025% maximum.

Silicon should be maintained in the range of 0.15 to 0.35 for its contribution to deoxidation in the steel making process. Silicon is an inexpensive alloy that increases the hardenability of the steel while also contributing to its wear resistance, and must not be reduced below the above level. Increased levels of silicon in amounts greater than the range specified can affect the solidification behavior of the steel, possibly resulting in ingot flaws such as primary and secondary pipe.

Nickel should be maintained in the range of 0.80 to 1.40% for its contribution to toughness, hardenability, and improved resistance to heat checking. Increased nickel concentrations, however, increase the amount of retained austenite in steel. If the retained austenite decomposes to untempered martensite in a die steel during use as a forging die, a hard, brittle phase may develop that can lead to catastrophic die failure. Nickel is also one of the most costly alloys and should therefore be limited to the above range in order to make the steel alloy price competitive.

Chromium is increased by an amount which is significant in these specialized applications as contrasted to the ranges set out in U.S. Pat. No. 4,318,739, and should be present in the range of 0.85–1.30 or, preferably, in the range of 1.00–1.30. The increase in the chromium concentration as contrasted to U.S. Pat. No. 4,318,739 offsets the decrease in hardenability due to the decreased carbon content of the steel without affecting the positive attributes of the material. It is believed that the additional amount of chromium increases the wear resistance of the material through the increased formation of chromium carbides.

The molybdenum content is also increased by an amount which is significant in the above-described specialized applications as contrasted to the ranges set out in U.S. Pat. No. 4,318,739 and should be present in the range of 0.40–0.85. Molybdenum increases the hardenability of the steel while reducing the possibility of temper embrittlement. Molybdenum is a strong carbide former that improves wear resistance. A trial heat was made with molybdenum increased to near the top of the broad range. The physical properties and ductility of the material were significantly improved. The addition of molybdenum did, however, increase the quench crack sensitivity of the material, making it much more difficult to process using drastic quenching techniques. As a result, molybdenum levels should be maintained in the range of 0.40–0.55% for drastic quenching applications, but can be shifted to a higher range of 0.65–85% for less drastic quenching applications.

Vanadium should be present in any amount up to 0.30, but preferably in the range of 0.04–0.10%.

Aluminum should be present in any amount up to 0.030, but preferably in the range of 0.015–0.025.

Titanium should be present in any amount in the range 0.003–020, but preferably in the range of 0.005–015.

The martensite transformation temperatures of the material have been calculated and compared to the transformation temperatures of the steel of U.S. Pat. No. 4,318,739. The values can be found in the graph in FIG. 1. As can be seen from the graph the martensite start temperature is raised (martensite 0% temperature), as well as the amount of martensite that would be formed at temperatures typically encountered at the end of the quench process. The graph indicates that there is an increased amount of austenite transformed to martensite, which after tempering, increases the ductility of the material. For example, the projecting lines from an end quench temperature of 400° F. show approximately 60% martensite transformation in the new steel as contrasted to only about 50% transformation in the steel of U.S. Pat. No. 4,318,739, which is approximately a 20% increase.

Figure 2:
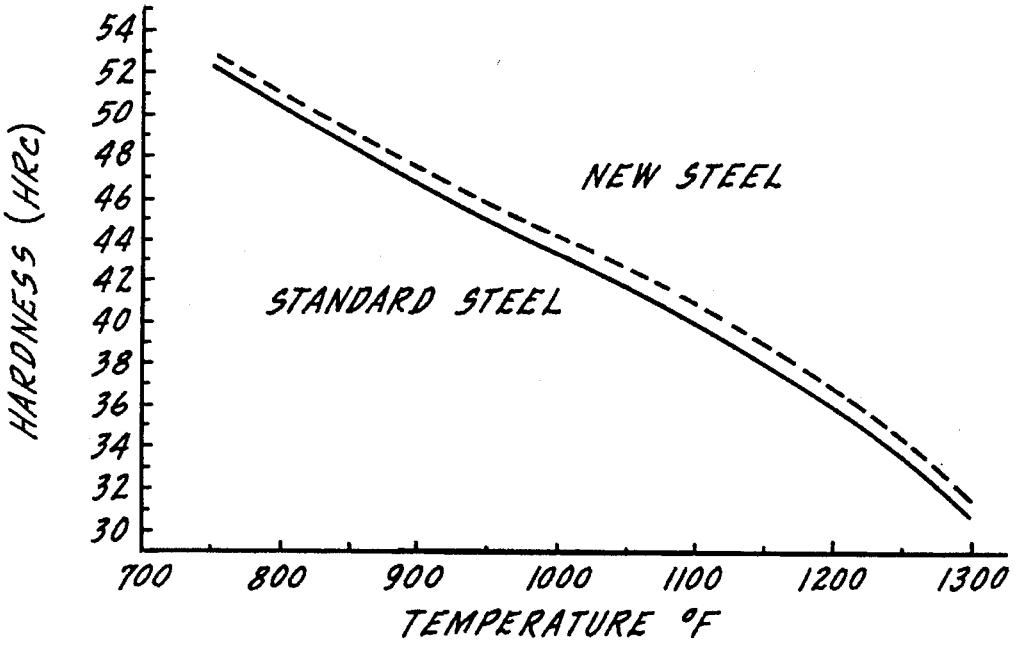
FIG. 2 is a diagram of a tempering response curve of the steel and product of this invention as contrasted to a steel and product known in the prior art.

To determine if the chemistry change would have any effect on the heat treatment of the material or the resistance to softening of the material when used as a die, a tempering response curve is presented in FIG. 2. As can be seen from FIG. 2 the chemistry increases slightly the resistance to tempering of the material. This is a beneficial result in that in die applications, die failure occasionally occurs due to overheating, and subsequent softening, of the die. The soft die then wears out prematurely.

Heats of the new chemistry were cast. The chemical compositions of two of the heats can be found in Table 1. Test blocks (10"×10"×12") were forged and heat treated from each heat.

TABLE 1

| | New Steel Heats | |
|---|---|---|
| | Heat # 238372 | Heat # 238420 |
| C | .50 | .52 |
| Mn | .87 | .89 |
| P | .009 | .006 |
| S | .015 | .018 |
| Si | .30 | .30 |
| Ni | .94 | .98 |
| Cr | 1.16 | 1.16 |
| Mo | .47 | .49 |
| V | .05 | .05 |
| Al | 0.022 | .022 |
| Ti | .015 | .010 |

The surface and center of the test blocks were measured. The center hardness of the test blocks were, after averaging, less than one Rockwell number greater than the standard chemistry (37.6 versus 37 HRc). This increase in center hardness, at the same tempering temperature, is a slight improvement over the standard chemistry, and verifies that the chemistry modification was not detrimental to the hardenability of the material which might have been expected.

Transverse tensile samples were obtained from the center of the test blocks. The center location was chosen because it is the location and direction that is most difficult to achieve adequate physical properties in a forging. The center location is frequently the location of the highest stress concentration in a die block due to the geometry, location, and depth of the die impression.

Figure 3:
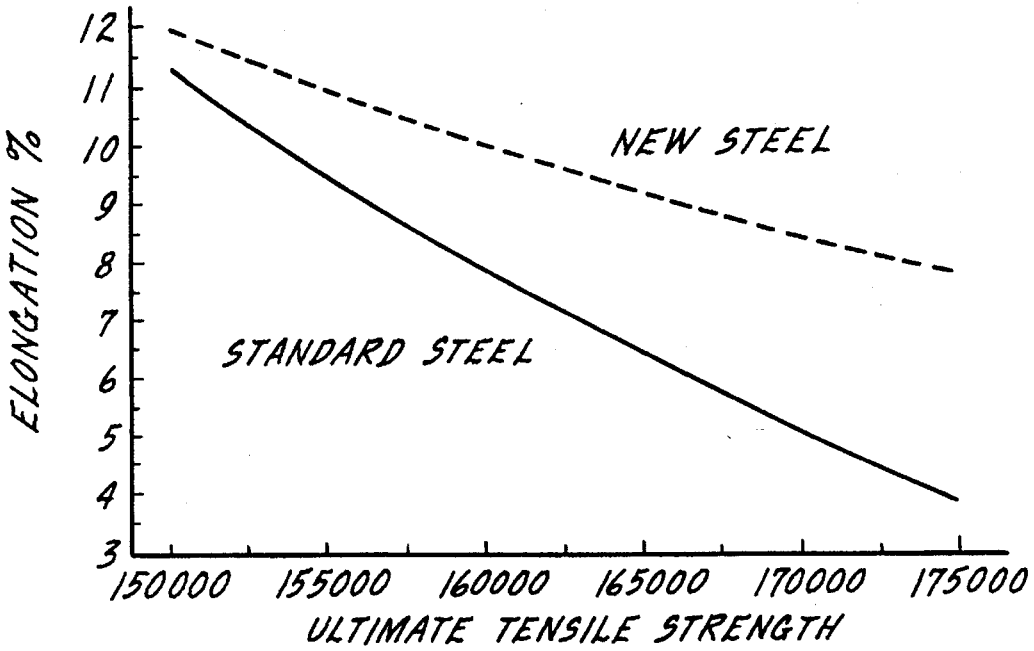
FIG. 3 is a diagram showing the increase in ductility of the steel of this invention in comparison to a known prior art steel.

The test data clearly show an increase in the ductility of the new steel versus the standard steel. The information representing the increase in elongation can be found in FIG. 3 from which it will be noted that at a UTS of 170,000, the elongation increased from about 5% to about 8½% , or an increase in comparative terms of approximately 70%.

Figure 4:
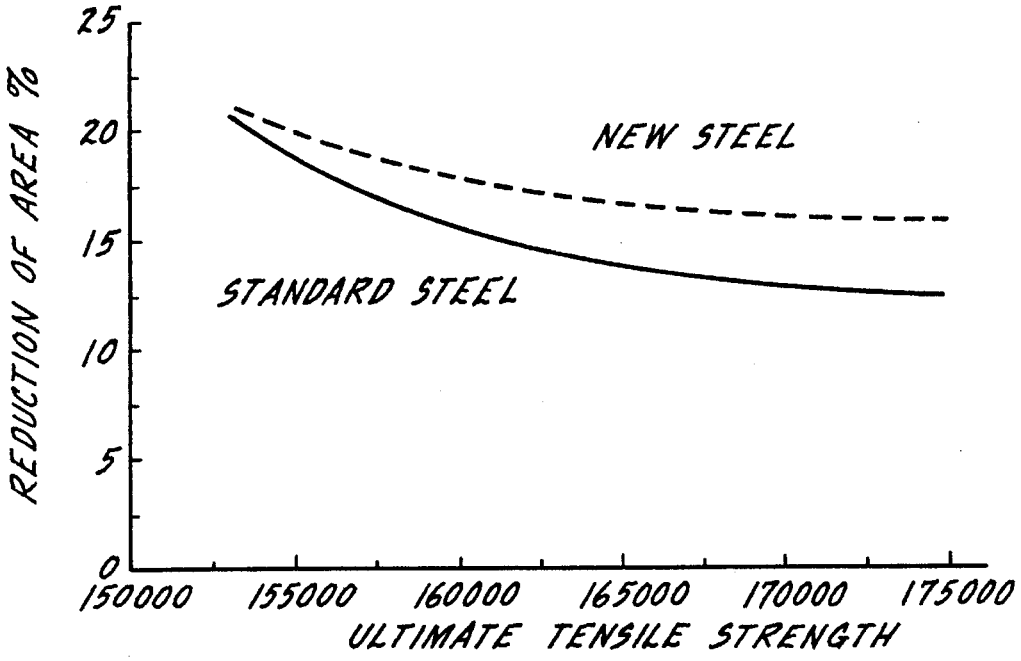
FIG. 4 is a diagram showing the increase in the reduction of area transverse which is attained by the steel of this invention as contrasted to a known prior art steel.

The improvement in reduction of area can be seen in FIG. 4 from which it will be noted that at 170,000 UTS the reduction in area increased from about 12½% to about 16%, or an increase in comparative terms of approximately 28%.

From the foregoing it will be observed that relatively modest, but important, changes in the chemistry of a standard steel lead to surprisingly high increases in room temperature ductility without sacrificing essential elevated temperature characteristics of high strength, high wear resistance, high hardenability and easy machining.

Although a preferred embodiment of the invention has been illustrated and described, it will at once be apparent to those skilled in the art that various modifications and changes may be made within the spirit and scope of the invention. Accordingly, it is intended that the scope of the invention be limited solely by the hereafter appended claims when interpreted in light of the relevant prior art, and not by the foregoing exemplary description.

I claim:

1. A dual purpose steel having both high ductility at room temperature and high strength, high hardness, high wear resistance and high hardenability at elevated temperatures above 300° F. together with easy machinability, said steel having the following composition:

| | |
|---|---|
| C | .48–.53 |
| Mn | .75–.95 |
| P | .025x |
| S | .025x |
| Si | .15–.35 |
| Ni | .80–1.40 |
| Cr | 1.00–1.30 |
| Mo | .65–.85 |
| V | .04–.10 |
| Al | .015–.025 |
| Ti | .005–.015 |

balance Fe and usual impurities, said steel being in a non-drastic quenched condition.

2. A closed die forging die having both high ductility at room temperature and high strength, high hardness, high wear resistance and high hardenability at elevated temperatures above 300° F. together with easy machinability, said steel having the following composition:

| | |
|---|---|
| C | .48–.53 |
| Mn | .75–.95 |
| P | .025X–.025X |
| S | .025X |
| Si | .15–.35 |
| Ni | .80–1.40 |
| Cr | 1.00–1.30 |
| Mo | .65–.85 |
| V | .04–.10 |
| Al | .015–.025 |
| Ti | .005–.015 |

balance Fe and usual impurities, said steel being in a non-drastic quenched condition.

3. A gear, pinion, piston, crankshaft or other machine part having high ductility at room temperature together with high strength, high hardness, high wear resistance and easy machinability at elevated temperatures above 300° F., said steel having the following composition:

| | |
|---|---|
| C | .48–.53 |
| Mn | .75–.95 |
| P | .025x |
| S | .025x |
| Si | .15–.35 |
| Ni | .80–1.40 |
| Cr | 1.00–1.30 |
| Mo | .65–.85 |
| V | .04–.10 |
| Al | .015–.025 |
| Ti | .005–.015 |

balance Fe and usual impurities, said steel being in a non-drastic quenched condition.

* * * * *